US010752461B2

(12) United States Patent
Shimizu et al.

(10) Patent No.: US 10,752,461 B2
(45) Date of Patent: Aug. 25, 2020

(54) ADHESIVE TAPE APPLICATION DEVICE, LINE MEMBER CONNECTION DEVICE INCLUDING ADHESIVE TAPE APPLICATION DEVICE, ADHESIVE TAPE APPLICATION METHOD, AND LINE MEMBER CONNECTION METHOD INCLUDING ADHESIVE TAPE APPLICATION METHOD

(71) Applicant: Panasonic Intellectual Property Management Co., Ltd., Osaka (JP)

(72) Inventors: Kazumichi Shimizu, Osaka (JP); Yoshihiro Owaki, Osaka (JP); Masaki Yoshida, Nara (JP); Akihiro Yamamoto, Hyogo (JP); Yu Kawai, Fukui (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 410 days.

(21) Appl. No.: 14/608,290

(22) Filed: Jan. 29, 2015

(65) Prior Publication Data

US 2015/0217963 A1 Aug. 6, 2015

(30) Foreign Application Priority Data

Feb. 3, 2014 (JP) ..... 2014-018144

(51) Int. Cl.
*B65H 35/00* (2006.01)
*B65H 35/06* (2006.01)
*B65H 16/00* (2006.01)

(52) U.S. Cl.
CPC ..... *B65H 35/0013* (2013.01); *B65H 16/005* (2013.01); *B65H 35/008* (2013.01);
(Continued)

(58) Field of Classification Search
CPC ..... B65H 2404/10; B65H 2404/11; B65H 2404/111; B65H 2404/112;
(Continued)

(56) References Cited

U.S. PATENT DOCUMENTS 2,473,599 A * 6/1949 Liebel ..... B05C 3/125 226/179
3,717,540 A * 2/1973 Henc ..... B31B 50/00 156/436

(Continued)

FOREIGN PATENT DOCUMENTS

CN 2651213 10/2004
CN 1680181 10/2005

(Continued)

OTHER PUBLICATIONS

Office Action with Search Report dated Apr. 27, 2017 in Chinese Patent Application No. 201510043548.9, with English-language translation of Search Report.

*Primary Examiner* — Alex B Efta
(74) *Attorney, Agent, or Firm* — Wenderoth, Lind & Ponack, L.L.P.

(57) ABSTRACT

A line member connection device which applies an adhesive tape includes: a supply reel which supplies the adhesive tape; a cutter which cuts the adhesive tape drawn from the supply reel; and an intermediate roller via which the adhesive tape drawn from the supply reel is directed to the cutter, the intermediate roller being disposed between the supply reel and the cutter, wherein in cross section taken along a rotation axis of the intermediate roller, a surface of the first roller which supports the adhesive tape is shaped to have a straight section parallel to the rotation axis, and a first inclined section inclined relative to the rotation axis.

14 Claims, 12 Drawing Sheets

(52) U.S. Cl.
CPC ..... *B65H 35/06* (2013.01); *B65H 2404/1313* (2013.01); *B65H 2701/18444* (2013.01); *Y10T 156/1062* (2015.01); *Y10T 156/12* (2015.01)

(58) Field of Classification Search
CPC ..... B65H 2404/13; B65H 2404/1312; B65H 2404/1313; B65H 2404/1314; B65H 2404/1315; B65H 2404/1316; B65H 2404/1317; B65H 2404/13171; B65H 23/0251; B65H 23/035; B65H 23/025; B65H 27/00; F16C 13/003; F16C 13/006
See application file for complete search history.

(56) References Cited

U.S. PATENT DOCUMENTS 4,324,372 A * 4/1982 Majicek ..... G11B 23/08778 226/59
5,038,492 A * 8/1991 Bryant ..... E04G 21/1891 156/523
7,306,181 B1 * 12/2007 Kartik ..... B65H 23/26 242/346.2
8,886,098 B2 * 11/2014 Fromm ..... G03G 15/2053 399/329
2005/0199760 A1 9/2005 Shearer et al.
2013/0098557 A1 * 4/2013 Takeuchi ..... B65H 35/004 156/349
2013/0133717 A1 5/2013 Maki et al.

FOREIGN PATENT DOCUMENTS

JP 06-078354 U 11/1994
JP 2004-345849 12/2004
JP 2009-295940 12/2009
JP 2012-015289 1/2012
JP 2013-075750 4/2013
JP 2013-211379 10/2013

* cited by examiner

ADHESIVE TAPE APPLICATION DEVICE, LINE MEMBER CONNECTION DEVICE INCLUDING ADHESIVE TAPE APPLICATION DEVICE, ADHESIVE TAPE APPLICATION METHOD, AND LINE MEMBER CONNECTION METHOD INCLUDING ADHESIVE TAPE APPLICATION METHOD

CROSS REFERENCE TO RELATED APPLICATION

The present application is based on and claims priority of Japanese Patent Application No. 2014-018144 filed on Feb. 3, 2014. The entire disclosure of the above-identified application, including the specification, drawings and claims is incorporated herein by reference in its entirety.

BACKGROUND OF THE INVENTION

1. Field of the Invention

The present invention relates to a device and a method for applying an adhesive tape. In particular, the present invention relates to a line member connection device and a line member connection method for cutting an adhesive tape to a necessary length, and applying the adhesive tape.

2. Description of the Related Art

Solar batteries can directly change inexhaustible solar energy into electrical energy, without discharging exhaust gas, for instance. Thus, there are growing expectations for solar batteries as energy sources which have little impact on the environment. The electrical output of solar batteries, however, is small. Besides, the cost of manufacturing a solar cell module which includes a plurality of solar cells connected with line members is quite high, compared to the cost of generating power using another technique.

Conventionally, solder material is widely used to connect a solar cell and a line member. However, it is necessary to fuse solder in order to connect a line member and a solar cell by soldering. There is a difference in coefficient of thermal expansion between a line member and a solar cell and furthermore, the soldering connecting process requires heating at a high temperature. Accordingly, connecting a solar cell and a line member causes a residual stress in the solar cell. This residual stress causes a distortion and a micro crack in the solar cell. This consequently leads to a decrease in productivity and yields in the manufacturing process and furthermore, reduces reliability of solar cell modules.

Japanese Unexamined Patent Application Publication No. 2009-295940, Japanese Unexamined Patent Application Publication No. 2012-15289, and Japanese Unexamined Patent Application Publication No. 2013-75750 disclose the use of an adhesive tape for connecting a solar cell and a line member.

Typical ways of winding an adhesive tape are roughly divided into two ways, namely, record winding and traverse winding.

Record winding is a way of winding an adhesive tape in a stacking manner around a supply reel having substantially the same width as the width of the adhesive tape such that the edge of the adhesive tape is aligned at the same position.

Traverse winding is a way of winding an adhesive tape in spiral at a certain degree around a supply reel having a greater width than the adhesive tape, and when the adhesive tape reaches an end of the supply reel, winding the adhesive tape in spiral toward the other end of the supply reel, which is repeated over and over in the width direction of the supply reel.

With regard to a line member connection device which is provided with a supply reel having an adhesive tape wound in the record winding manner, cuts the adhesive tape drawn from the supply reel to a necessary length, and connects a solar cell and a line member with this adhesive tape, such a line member connection device has a problem that the cost of a supply reel is high for the length of an adhesive tape that can be wound around a single supply reel since that length is limited. In addition, such a line member connection device also has a problem that the need to exchange a supply reel per certain length of a wound adhesive tape prevents an increase in productivity.

SUMMARY OF THE INVENTION

If the scheme of drawing a traverse wound adhesive tape from a supply reel is adopted, the length of an adhesive tape which can be wound around a single reel can be greatly increased compared to record winding. In view of this, if a supply reel having a traverse wound adhesive tape is provided in a line member connection device which supports record winding, the cost of a reel for a length of an adhesive tape can be reduced, and the number of times the supply reel is exchanged can be decreased. As a result, an improvement in productivity can be expected.

However, if a traverse winding supply reel is applied to a conventional line member connection device which supports record winding, when an adhesive tape drawn from a supply reel travels, the adhesive tape twists and tension varies due to the twists, causing variations in the length to cut the adhesive tape and accuracy of positions at which the cut adhesive tapes are applied. Accordingly, such a conventional line member connection device has a problem that leads to defective connection between a solar cell and a line member. Furthermore, the line member connection device has a problem, that is, a difficulty in increasing the speed at which equipment operates in order to improve productivity.

Japanese Unexamined Patent Application Publication No. 2013-75750 discloses, not a line member connection device, but a take-up device for traverse winding a linear member around a supply reel. A description of this take-up device is given with reference to FIG. 1. Motor 12 rotates cylindrical roller 11, and at the same time reel 16 is moved in an axial direction using motor 13, guide 14, and position sensors 15, thus allowing traverse winding. A mechanism similar to the above is also applicable for unwinding (which although differs from taking up), and thus it is conceivable to provide a line member connection device with an unwinding device having a mechanism equivalent to that disclosed in Japanese Unexamined Patent Application Publication No. 2013-75750 so that the line member connection device supports a traverse winding supply reel. This, however, requires a motor which moves a cylindrical fixed roller in an axial direction of a bobbin for taking up a plating line, a guide, and position detection sensors, and also requires the control of such constituent elements. Accordingly, existing line member connection equipment needs to be upgraded, which requires huge cost. Alternatively, the equipment may not be upgraded due to a spatial limitation for securing a space for a path of an adhesive tape traveling in the line member connection equipment. Furthermore, when such equipment is newly designed, the cost of the equipment will be very high.

The present invention addresses the above problems of the conventional devices, and an object of the present invention is to provide a line member connection device having a simple structure that supports both a record winding supply reel and a traverse winding supply reel.

An adhesive tape application device according to an aspect of the present invention is an adhesive tape application device including: a supply reel which supplies an adhesive tape; a cutter which cuts the adhesive tape drawn from the supply reel; a first roller via which the adhesive tape drawn from the supply reel is directed to the cutter, the first roller being disposed between the supply reel and the cutter; and an applicator which applies the adhesive tape cut by the cutter onto an object, wherein in cross section taken along a rotation axis of the first roller, a surface of the first roller which supports the adhesive tape is shaped to have a straight section parallel to the rotation axis, and a first inclined section inclined relative to the rotation axis.

A line member connection device according to an aspect of the present invention is a line member connection device including: the above adhesive tape application device; and a connector which places a line member on the adhesive tape, and presses the line member toward the object to electrically connect the line member to the object.

An adhesive tape application method according to an aspect of the present invention is an adhesive tape application method including: drawing an adhesive tape from a supply reel; directing the adhesive tape drawn from the supply reel to a cutter via a first roller; cutting the adhesive tape with the cutter; and applying the adhesive tape cut with the cutter onto an object, wherein in cross section taken along a rotation axis of the first roller, a surface of the first roller which supports the adhesive tape is shaped to have a straight section parallel to the rotation axis, and a first inclined section inclined relative to the rotation axis.

A line member connection method according to an aspect of the present invention is a line member connection method including: the above adhesive tape application method; and placing a line member on the adhesive tape applied on the object, and pressing the line member to electrically connect the line member to the object.

According to this configuration, by merely adopting a simple configuration of directing a resin adhesive film via an intermediate roller which includes a straight section and an inclined section, even when a resin adhesive film is supplied from a traverse winding supply reel, twists of the adhesive tape and a variation in tension due to the twists are inhibited, thus reducing defective connections. Further, the use of a traverse winding supply reel achieves a reduction in the cost of reels, and improvement in productivity resulting from a decrease in frequency of exchange of a supply reel.

BRIEF DESCRIPTION OF DRAWINGS

These and other objects, advantages and features of the invention will become apparent from the following description thereof taken in conjunction with the accompanying drawings that illustrate a specific embodiment of the present invention.

DETAILED DESCRIPTION OF THE PREFERRED EMBODIMENTS

First Exemplary Embodiment

FIGS. 2A to 2D illustrate a first exemplary embodiment.

Figure 1:
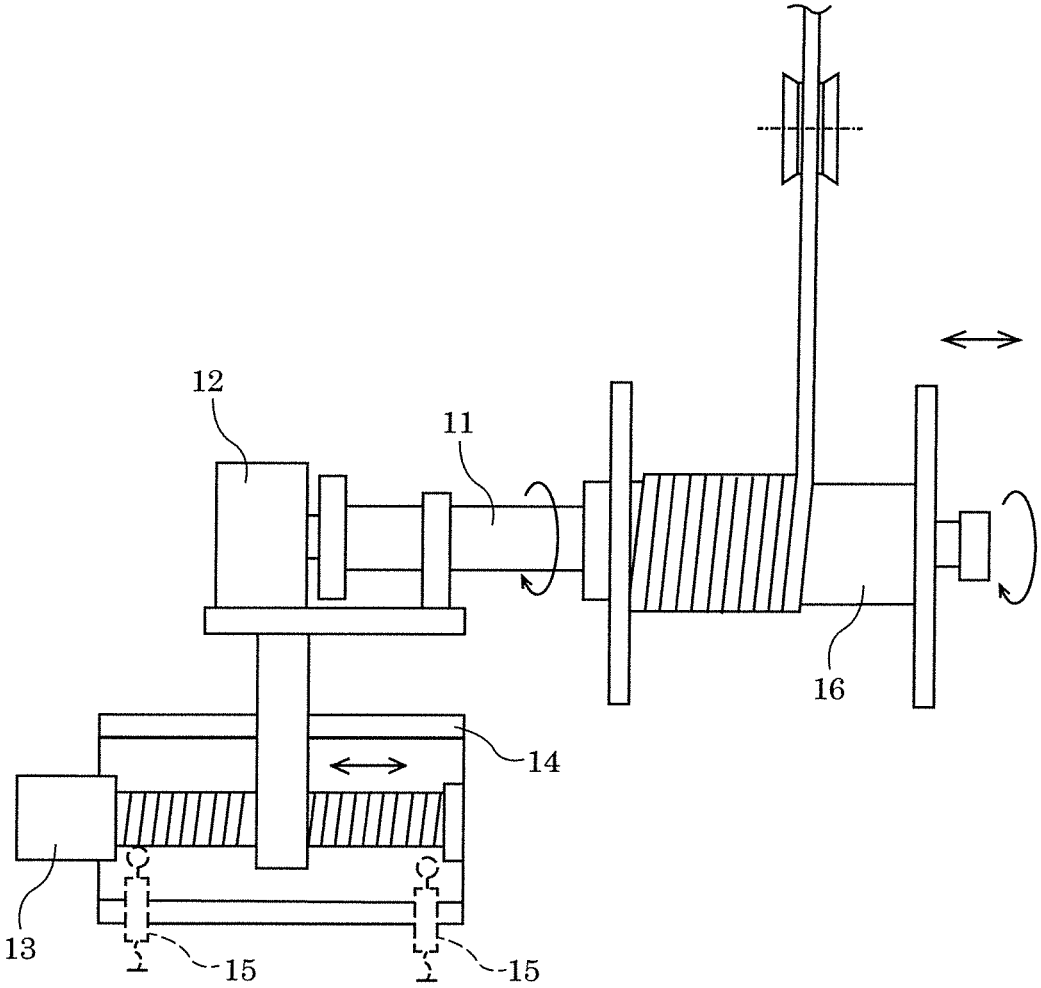
FIG. 1 Prior Art
FIG. 1 is an explanatory diagram of a conventional device which winds a tape around a traverse winding supply reel.
Figure 2A:
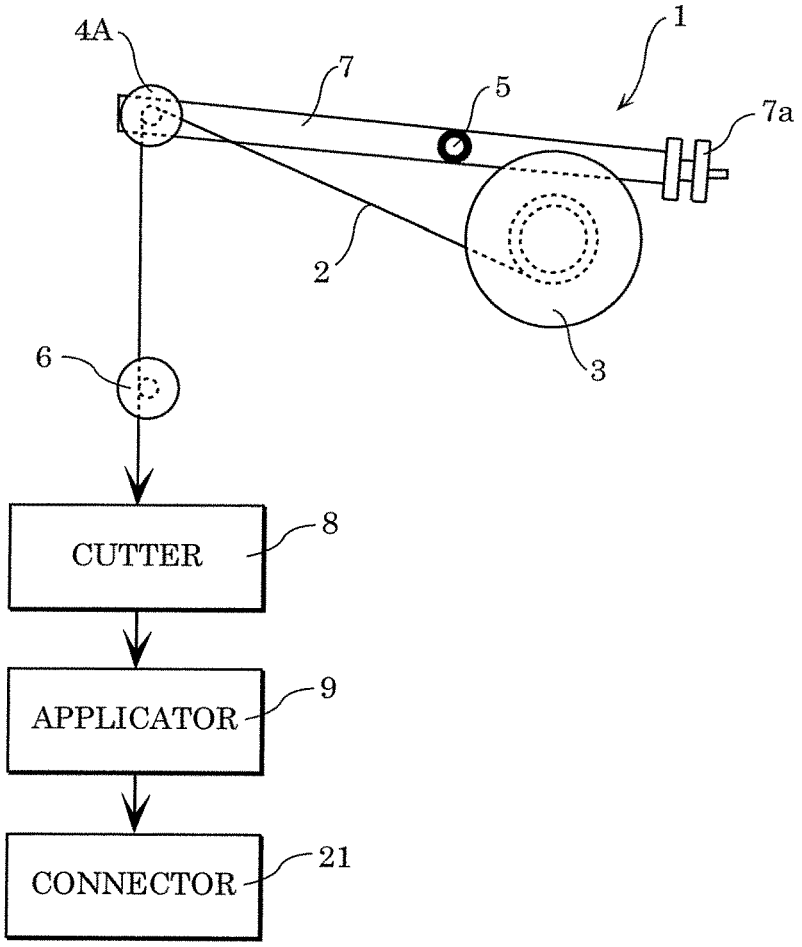
FIG. 2A is a front view of a line member connection device according to a first exemplary embodiment provided with a traverse winding supply reel.
Figure 2B:
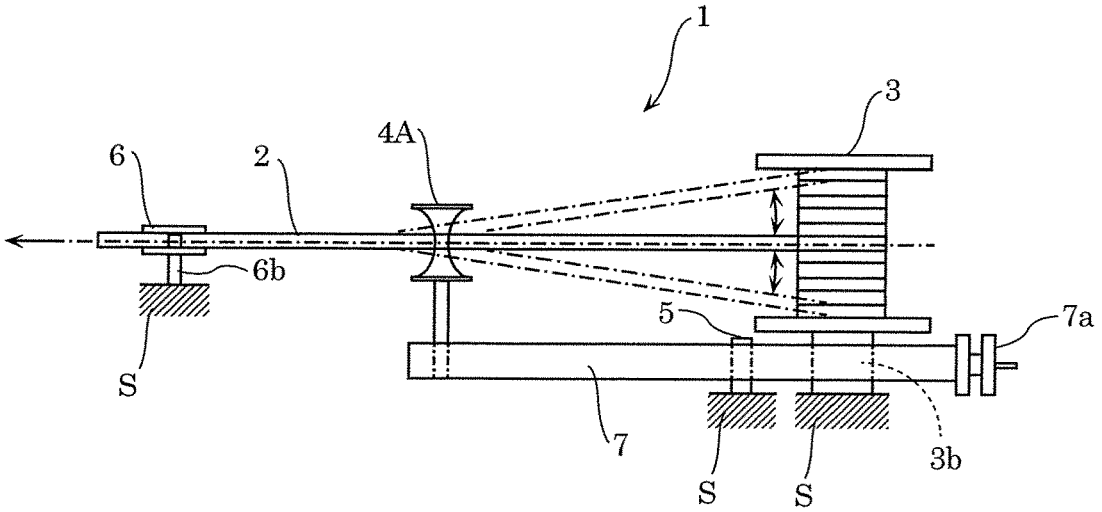
FIG. 2B is a top view of the line member connection device according to the first exemplary embodiment provided with the traverse winding supply reel.
Figure 2C:
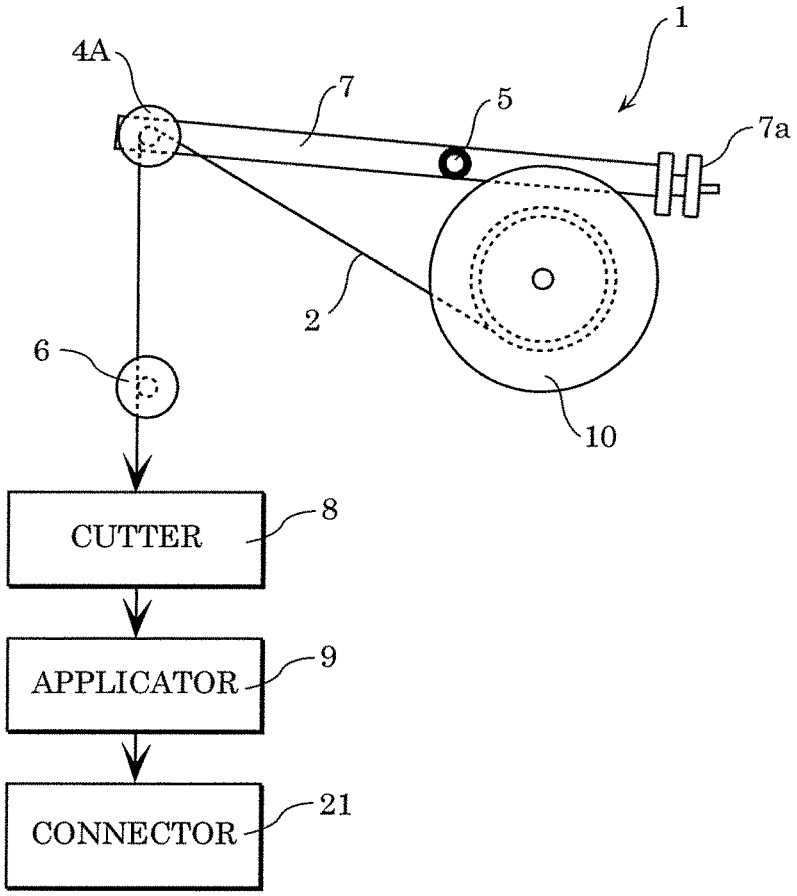
FIG. 2C is a front view of the line member connection device according to the first exemplary embodiment provided with a record winding supply reel.
Figure 2D:
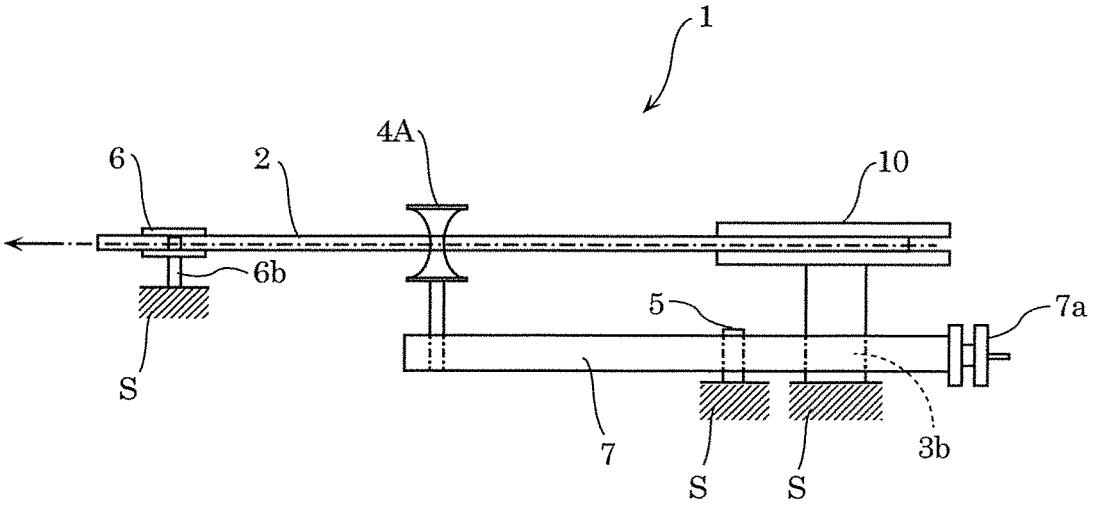
FIG. 2D is a top view of the line member connection device according to the first exemplary embodiment provided with the record winding supply reel.

FIGS. 2A and 2B illustrate line member connection device 1 provided with a traverse winding supply reel, and FIGS. 2C and 2D illustrate line member connection device 1 provided with a record winding supply reel.

Figure 3:
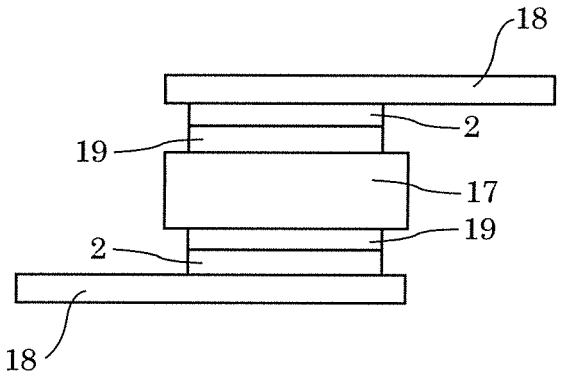
FIG. 3 is a cross-sectional view of a connected portion where line members are connected to a solar cell with adhesive tapes.

Line member connection device 1 applies an adhesive tape on a portion where a solar cell and a line member are to be connected. FIG. 3 illustrates a cross section of a connected portion where line members 18 are connected to solar cell 17 with adhesive tapes 2. Cell electrodes 19 are on the sides of solar cell 17.

In FIGS. 2A and 2B, adhesive tape 2 is provided being traverse wound around supply reel 3. Supply reel 3 is attached to support shaft 3*b* provided on chassis S, for example.

Adhesive tape 2 drawn from supply reel 3 is supplied to cutter 8 via first roller 4A which is an intermediate roller, and second roller 6 disposed on the entrance side of cutter 8. For example, second roller 6 is attached to support shaft 6*b* provided on chassis S.

First roller 4A is attached on one side of balancer 7 having a center supported pivotably about support shaft 5. Counterweight 7*a* is attached to the other side of balancer 7. For example, support shaft 5 is provided on chassis S.

Cutter 8 cuts adhesive tape 2 to a predetermined length. Applicator 9 applies adhesive tape 2 having the predetermined length supplied from cutter 8 onto a portion where solar cell 17 and line member 18 are connected. Connector 21 first places line member 18 on adhesive tape 2 applied on solar cell 17, and then presses line member 18 toward solar cell 17. As a result, connector 21 electrically connects solar cell 17 and line member 18.

Figure 4A:
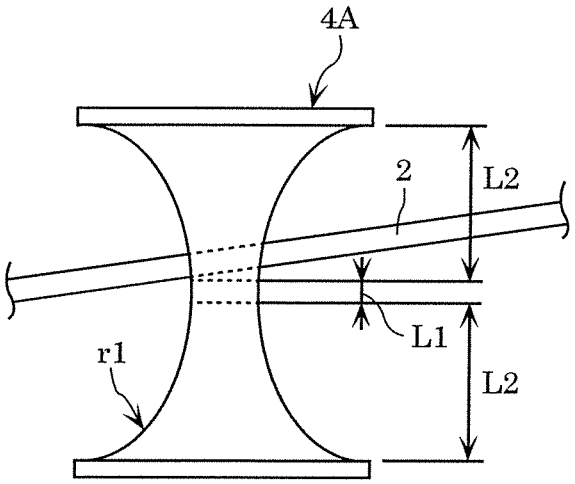
FIG. 4A is a plan view illustrating a first roller which is an intermediate roller and an inclination of a passing adhesive tape, in the line member connection device according to the first exemplary embodiment.
Figure 4B:
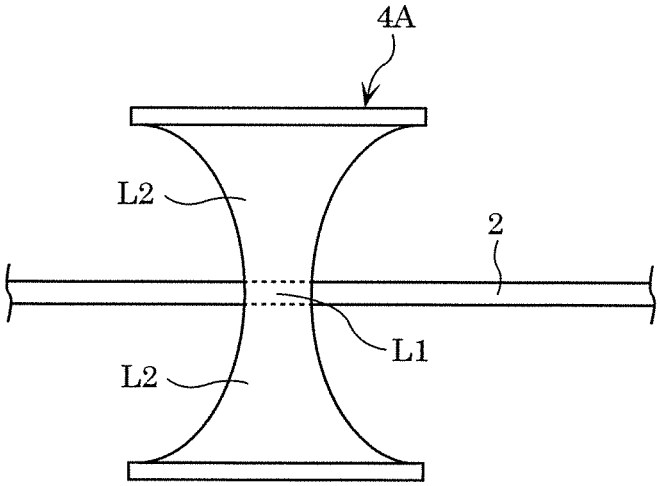
FIG. 4B is a plan view illustrating the first roller which is the intermediate roller and the passing adhesive tape, in the line member connection device according to the first exemplary embodiment.

It should be noted that FIG. 2B illustrates, for convenience, second roller 6 on the straight line from the first roller 4A in order to facilitate the understanding of the path along which adhesive tape 2 is guided. FIGS. 4A and 4B illustrate the shape of first roller 4A. FIGS. 4A and 4B illustrate adhesive tape 2 at different positions.

FIGS. 4A and 4B illustrate cross sections of first roller 4A taken along a rotation axis. In the cross sections, portions (lateral surfaces) in contact with adhesive tape 2 are each shaped to have straight section L1 and first inclined sections L2 which are concave curves having curvature r1. The length of straight section L1 is equal to or greater than the width of adhesive tape 2, and first inclined sections L2 are provided on the sides of straight section L1. The center of straight section L1 of first roller 4A, the center of second roller 6, and the center of the width of supply reel 3 are aligned as illustrated in FIG. 2B.

As illustrated by the solid lines and imaginary lines in FIG. 2B, the position at which adhesive tape 2 is drawn from supply reel 3 shifts in the range of the width of supply reel 3. Accordingly, the positional relationship between supply reel 3, first roller 4A, and adhesive tape 2 is determined depending on the distance from supply reel 3 to first roller 4A and the width of supply reel 3.

The length of straight section L1 needs to be the same as or longer than the width of adhesive tape 2 to be drawn. Specifically, if the width of adhesive tape 2 is 1.0 mm, it is sufficient if the length of straight section L1 is 1.1 mm or more, in consideration of the tolerance of the width of adhesive tape 2. It is sufficient if curvature r1 of first inclined sections L2 is 2 mm or more and the central angle is 90 degrees at maximum. First inclined sections L2 have, for example, concave curves, but may be straight.

Even when the guiding direction of adhesive tape 2 is changed at first roller 4A to turn at an acute angle (which is formed by supply reel 3 and second roller 6 about first roller 4A) as illustrated in FIG. 2A, adhesive tape 2 is directed along first roller 4A and thus is not bent. In addition, even if adhesive tape 2 and the rotation axis of first roller 4A form a wide angle, adhesive tape 2 is guided by second roller 6. Since bends of adhesive tape 2 are prevented, the tension applied from balancer 7 onto adhesive tape 2 is maintained constant by the pivot of balancer 7.

The tension applied to adhesive tape 2 drawn from supply reel 3 is maintained constant by balancer 7. This achieves stability of the length to cut adhesive tape 2 by cutter 8. Furthermore, the accuracy of positions at which applicator 9 applies adhesive tapes 2 is stabilized.

The stability of the length to cut adhesive tape 2 and accuracy in application positions improves reliability of solar cell module 17.

Even if the position at which adhesive tape 2 is drawn shifts in the range of the width of supply reel 3 (FIG. 2B), adhesive tape 2 can stably and continuously shift on first roller 4A, which allows stable cut and application of adhesive tape 2, since the center of straight section L1 of first roller 4A, the center of second roller 6, and the center of the width of supply reel 3 are aligned, and first roller 4A has straight section L1 and first inclined sections L2 having curvature r1.

Since first roller 4A has straight section L1, when adhesive tape 2 is drawn from traverse winding supply reel 3 at the center of the width of supply reel 3, the width direction of adhesive tape 2 and the straight direction of straight section L1 are parallel to each other as illustrated in FIG. 4B, thus allowing adhesive tape 2 to be guided without being deformed in the width direction.

It has been checked that adhesive tape 2 can be stably cut and applied if curvature r1 of first inclined section L2 ranges from 2 mm or more to 34 mm at maximum.

FIGS. 2C and 2D respectively illustrate line member connection device 1 in which record winding supply reel 10 is used instead of traverse winding supply reel 3 as illustrated in FIGS. 2A and 2B. As with FIG. 2B, FIG. 2D also illustrates second roller 6 on a straight line from first roller 4A, for convenience.

As illustrated in FIG. 2D, the center of straight section L1 (FIG. 4B) of first roller 4A, the center of second roller 6, and the center of supply reel 10 in the width direction are aligned, which allows straight section L1 of first roller 4A to guide adhesive tape 2. Thus, the position at which adhesive tape 2 is drawn is constant even if record winding supply reel 10 is used.

As described above, the shape of first roller 4A has straight section L1 and curves having constant curvature r1 on the sides of straight section L1, thus achieving support for both traverse winding supply reel 3 and record winding supply reel 10, without changing first roller 4A.

Second Exemplary Embodiment

Figure 5A:
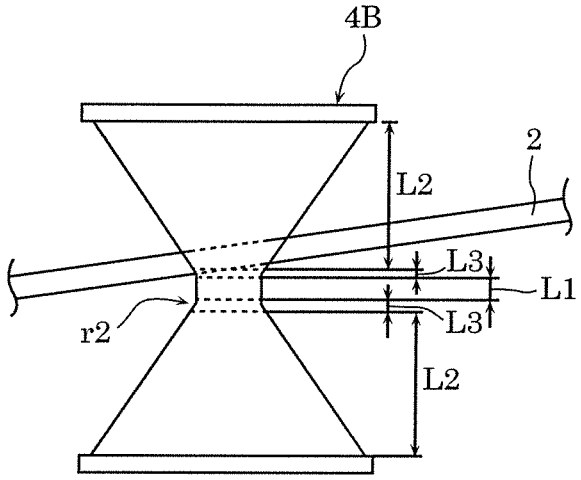
FIG. 5A is a plan view illustrating a first roller which is an intermediate roller and an inclination of a passing adhesive tape, in a line member connection device according to a second exemplary embodiment.
Figure 5B:
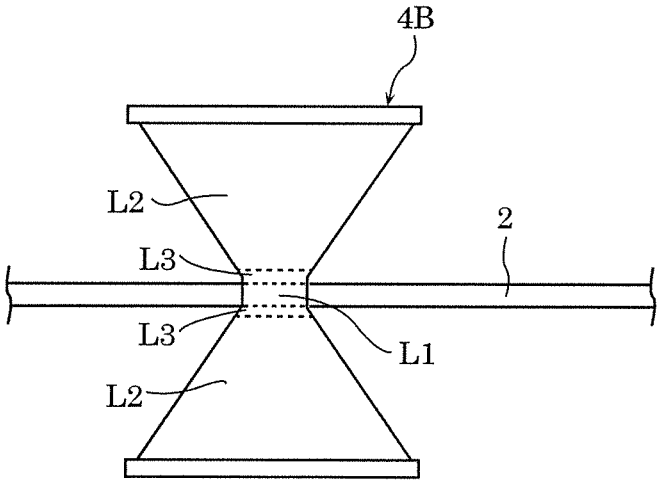
FIG. 5B is a plan view illustrating the first roller which is the intermediate roller and the passing adhesive tape, in the line member connection device according to the second exemplary embodiment.

FIGS. 5A and 5B illustrate a second exemplary embodiment. FIGS. 5A and 5B correspond to FIGS. 4A and 4B, respectively, and illustrate cross sections of first roller 4B taken along a rotation axis of first roller 4B. FIGS. 5A and 5B illustrate different positions of adhesive tape 2 on first roller 4B.

According to the first exemplary embodiment, first roller 4A has curved first inclined sections L2 on the sides of straight section L1, as illustrated in FIGS. 4A and 4B.

In contrast, in the cross-sectional shape of first roller 4B according to the second exemplary embodiment, first inclined sections L2 longer than straight section L1 are provided on the sides of straight section L1 of first roller 4B, and straight section L1 and first inclined sections L2 are connected by second inclined sections L3 having curvature r2. Second inclined sections L3 smoothly connect (continuously and gently) straight section L1 and first inclined sections L2. Second inclined sections L3 allow adhesive tape 2 to smoothly shift between straight section L1 and first inclined sections L2.

Other aspects are the same as the first exemplary embodiment, and adhesive tape 2 drawn from supply reel 3 is directed via first roller 4B.

The length of straight section L1 needs to be the same as or more than the width of adhesive tape 2 to be drawn, and specifically, if adhesive tape 2 is 1.0 mm, it is sufficient if the length of straight section L1 is 1.1 mm and first inclined section L2 is 3.0 mm or more, in consideration of the tolerance of the width of adhesive tape 2.

It should be noted that in this case, first inclined section L2 is, for example, straight, but may be a curve having curvature r1. Straight section L1, second inclined sections L3, and first inclined sections L2 need to be smoothly and gently extend outward in the stated order.

If second inclined section L3 and first inclined section L2 are straight, an inclination of first inclined sections L2 is greater than an inclination of second inclined sections L3.

If second inclined sections L3 and first inclined sections L2 are curved, the curvature of first inclined sections L2 is greater than the curvature of second inclined sections L3.

In addition, second inclined sections L3 each have a shorter length than straight section L1 and first inclined sections L2.

In the state where traverse winding supply reel 3 is provided in line member connection device 1, the center of straight section L1 of first roller 4B, the center of second roller 6 in the width direction, and the center of supply reel 3 in the width direction are aligned, which allows the position at which adhesive tape 2 is drawn to shift within the range of the width of supply reel 3, as with the case illustrated in FIG. 2B.

Even if first roller 4B has the shape as illustrated in FIGS. 5A and 5B, adhesive tape 2 is directed along first roller 4B without being bent, and guided by second roller 6 while a small angle is formed by the rotation axis of first roller 4B and the lateral surface of adhesive tape 2. The advantageous effects achieved by maintaining the tension applied onto adhesive tape 2 constant while balancer 7 is pivoting are equivalent to those described above in the first exemplary embodiment. Adhesive tape 2 can continuously shift on first roller 4B by straight section L1 and first inclined sections L2 of first roller 4B being connected with curves having curvature r2. Specifically, if curvature r2 is 2.0 mm, adhesive tape 2 is not bent and can be guided by second roller 6, and thus curvature r2 needs to be 2.0 mm or more. In the state where record winding supply reel 10 is provided in line member connection device 1, the center of straight section L1 of first roller 4B, the center of second roller 6, and the center of supply reel 10 in the width direction are aligned, thus allowing adhesive tape 2 to be guided to pass over straight section L1 of first roller 4B. Thus, even when record winding supply reel 10 is used, the position at which adhesive tape 2 is drawn is constant.

As described above, since the shape as illustrated in FIGS. 5A and 5B is employed for first roller 4B, supply reel 3 and supply reel 10 can be both supported. In addition, the shape of first roller 4B according to the second exemplary embodiment can be processed with less difficulty than the shape of first roller 4A according to the first exemplary embodiment.

Third Exemplary Embodiment

Figure 6A:
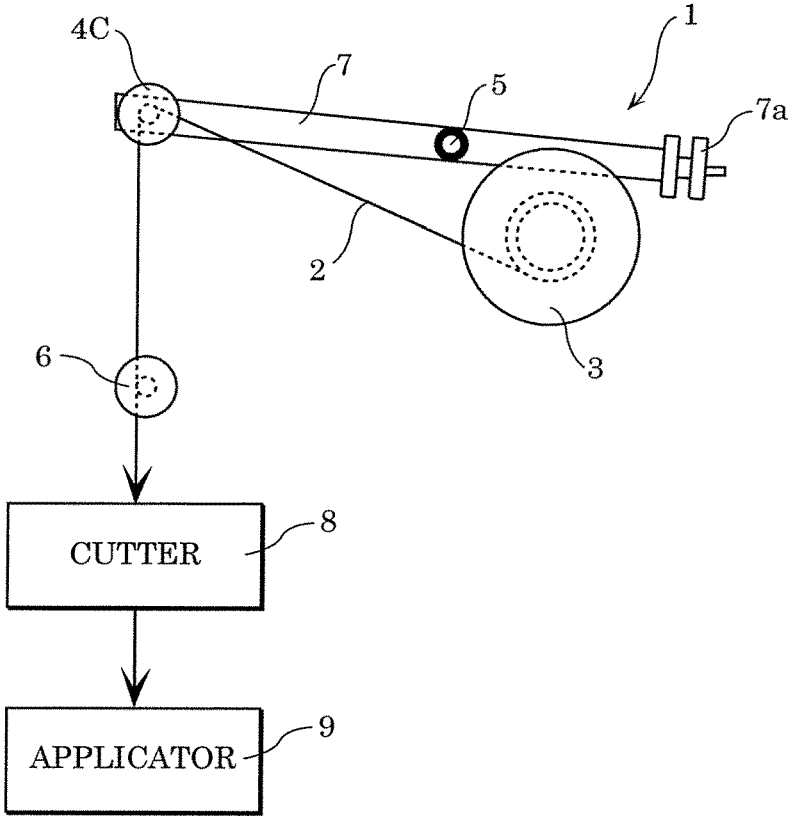
FIG. 6A is a front view of a line member connection device according to a third exemplary embodiment provided with a traverse winding supply reel.
Figure 6B:
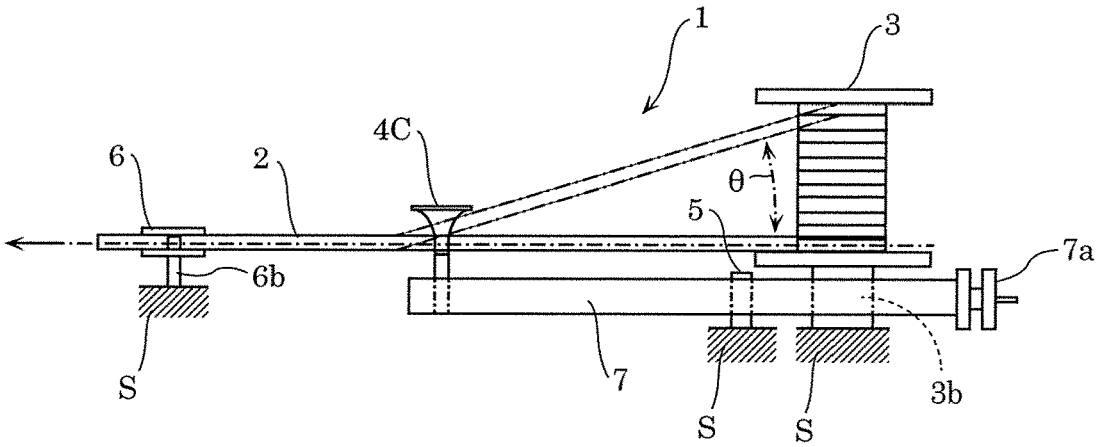
FIG. 6B is a top view of the line member connection device according to the third exemplary embodiment provided with the traverse winding supply reel.

FIGS. 6A, 6B, and 7 illustrate a third exemplary embodiment. FIGS. 6A and 6B correspond to FIGS. 2A and 2B, respectively.

Figure 6C:
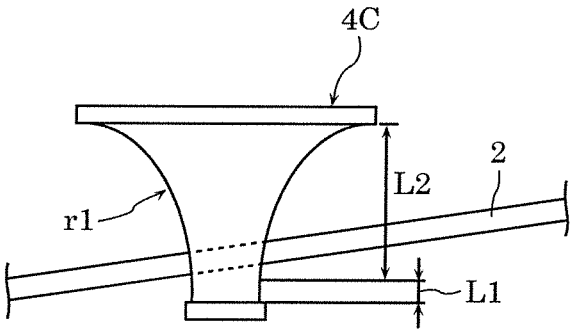
FIG. 6C is a plan view illustrating a first roller which is an intermediate roller and an inclination of a passing adhesive tape in the line member connection device according to the third exemplary embodiment provided with the traverse winding supply reel.
Figure 6D:
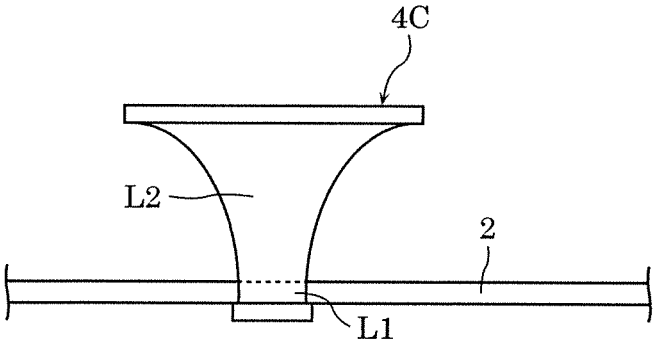
FIG. 6D is a plan view illustrating the first roller which is the intermediate roller and a passing adhesive tape, in the line member connection device according to the third exemplary embodiment provided with the traverse winding supply reel.

In the first exemplary embodiment, first roller 4A is shaped to have first inclined sections L2 on the sides of straight section L1, whereas in the third exemplary embodiment, first roller 4C is formed as illustrated in FIGS. 6C and 6D.

As shown by the cross sections of first roller 4C taken along the rotation axis, first roller 4C is shaped to have first inclined section L2 having curvature r1 on only one side of straight section L1.

FIGS. 6A and 6B illustrate a line member connection device provided with traverse winding supply reel 3. First roller 4C in this case is located being closer to an end of supply reel 3 in the width direction, as illustrated in FIG. 6B. The inner end wall of first roller 4C on the balancer 7 side and the inner end wall of supply reel 3 on the balancer 7 side are disposed in a substantially straight line. Other aspects are the same as the first exemplary embodiment.

A further detailed description of a positional relationship between first roller 4C and supply reel 3 is now given. A position distant from the inner end wall of supply reel 3 on the balancer 7 side by half the width of adhesive tape 2, the central point of straight section L1 of first roller 4C, the central point of a surface of second roller 6 which supports adhesive tape 2 (the center in the width direction of a surface in contact with adhesive tape 2) form one plane. The one plane is perpendicular to at least one of the rotation axis of first roller 4C, the rotation axis of second roller 6, or the rotation axis of supply reel 3.

It is sufficient if the length of straight section L1 is the same as or longer than the width of adhesive tape 2 to be drawn, as with the first exemplary embodiment. In addition, it is sufficient if curvature r1 of first inclined sections L2 is 2 mm or more, similarly, and a central angle is 90 degrees at maximum. If first roller 4C is disposed near one end of supply reel 3 in the width direction, angle θ (FIG. 6B) at which adhesive tape 2 comes into contact with first roller 4C is about twice the angle in the first exemplary embodiment. Adhesive tape 2 is directed along first roller 4C having straight section L1 and first inclined sections L2 and thus is not bent, and is further guided by second roller 6 while a small angle is formed by the lateral surface of adhesive tape 2 and the rotation axis of first roller 4C. The advantageous effects resulting from the tension applied to adhesive tape 2 being maintained constant by balancer 7 due to the avoidance of bends of adhesive tape 2 are equivalent as those described in the first exemplary embodiment above.

Figure 6E:
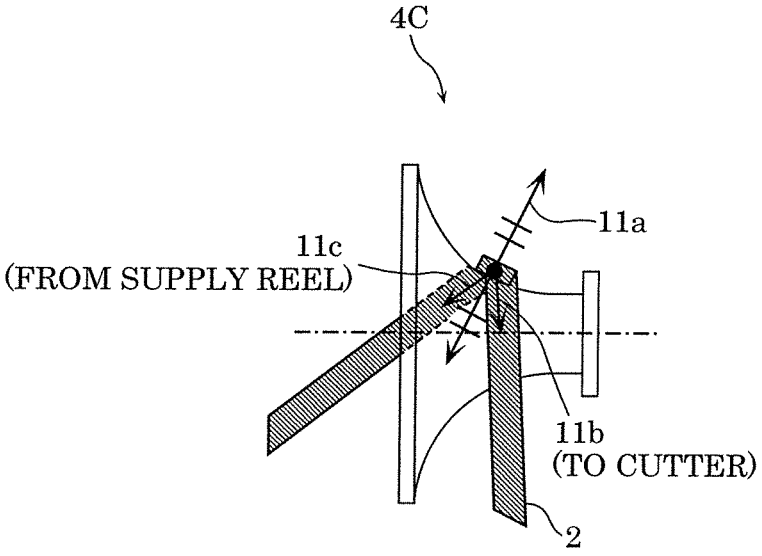
FIG. 6E is an explanatory diagram of balance of force at the first roller of the line member connection device according to the third exemplary embodiment provided with the traverse winding supply reel.

FIG. 6E illustrates a force relation between adhesive tape 2 and first roller 4C. FIG. 6E illustrates first roller 4C shown in FIG. 6A. Tape tension 11*c* of adhesive tape 2 on the supply reel 3 side and tape tension 11*b* exerted by second roller 6 are balanced with roller reaction force 11*a* of adhesive tape 2 on the first roller 4C side. Since the forces are balanced, adhesive tape 2 has no wrinkles, twists, and stress. As a result, adhesive tape 2 can be stably applied onto solar cell 17.

A position on supply reel 3 distant from the inner end wall on the balancer 7 side by half the width of adhesive tape 2, the central point of straight section L1 of first roller 4C, the central point of a surface of second roller 6 which supports adhesive tape 2 (the center in the width direction of a surface in contact with adhesive tape 2) form one plane. The one plane is perpendicular to at least one of the rotation axis of first roller 4C, the rotation axis of second roller 6, or the rotation axis of supply reel 3.

Accordingly, when adhesive tape 2 unwound from supply reel 3 is drawn from the balancer 7 side, adhesive tape 2 forms a straight shape perpendicular to first roller 4C as illustrated in FIG. 6D. Thus, adhesive tape 2 can be guided without being deformed in the width direction.

Figure 7A:
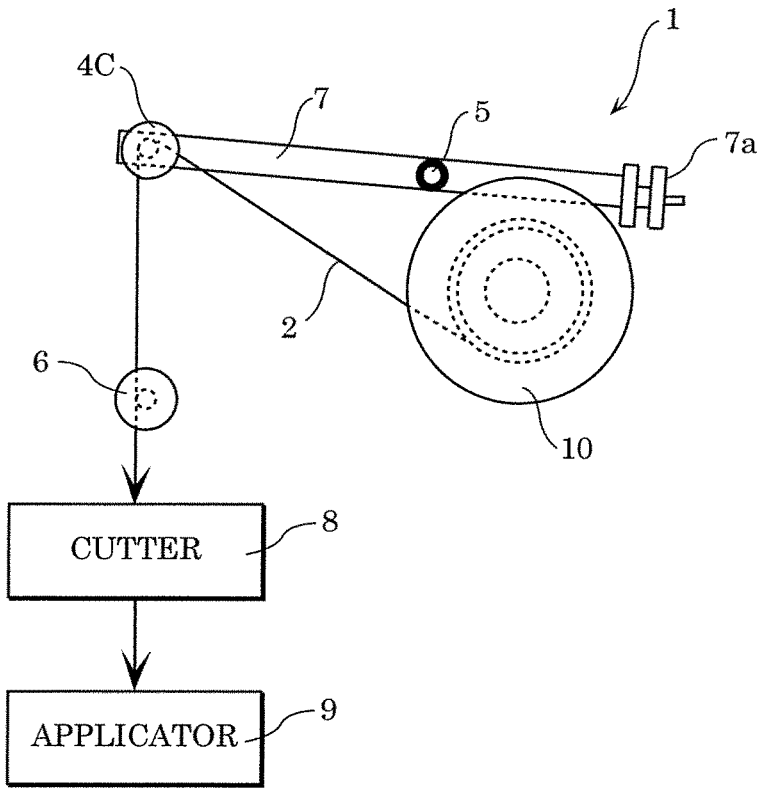
FIG. 7A is a front view of a line member connection device according to a fourth exemplary embodiment provided with a record winding supply reel.
Figure 7B:
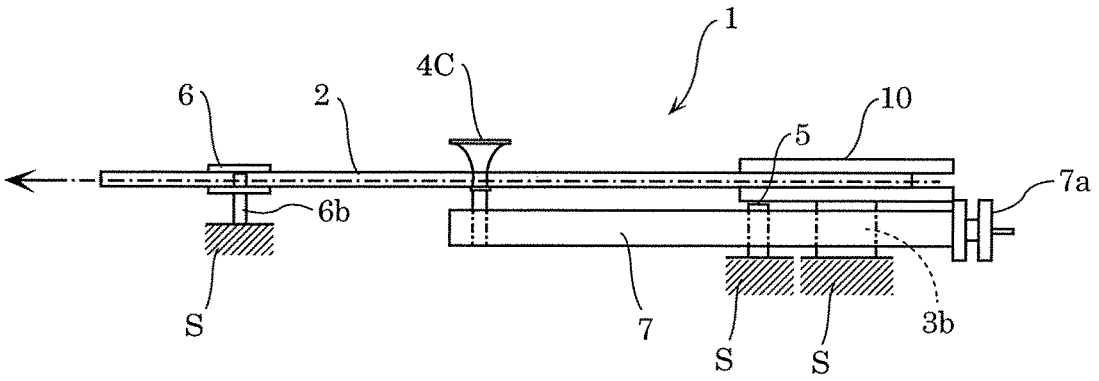
FIG. 7B is a top view of the line member connection device according to the fourth exemplary embodiment provided with the record winding supply reel.

FIGS. 7A and 7B illustrate the line member connection device provided with record winding supply reel 10. In this case, the center of supply reel 10 in the width direction is aligned with the center of straight section L1 of first roller 4C, as illustrated in FIG. 7B.

Thus, even when adhesive tape 2 is drawn from supply reel 10, adhesive tape 2 is positioned perpendicular to first roller 4C. Thus, adhesive tape 2 can be guided without being deformed in the width direction. Since first roller 4C has straight section L1 and inclined section L2 having constant curvature r1 on one side of straight section L1, traverse winding supply reel 3 and record winding supply reel 10 can be both supported without changing first roller 4C.

Fourth Exemplary Embodiment

Figure 8A:
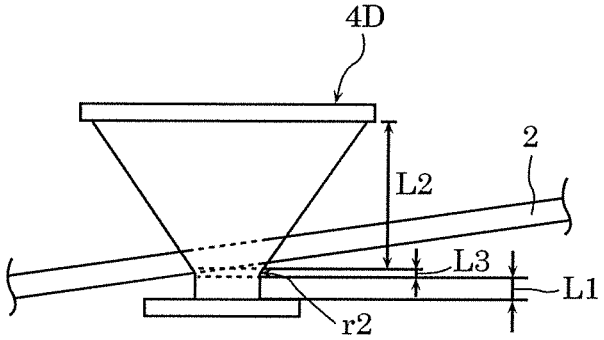
FIG. 8A is a plan view illustrating an inclination of a passing adhesive tape in the line member connection device according to the fourth exemplary embodiment.
Figure 8B:
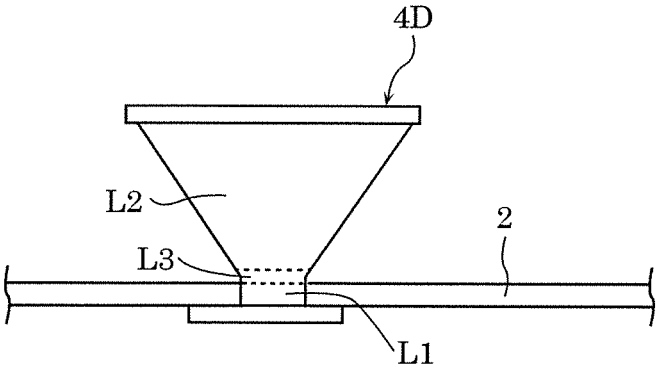
FIG. 8B is a plan view illustrating the shape of a first roller which is an intermediate roller in the line member connection device according to the fourth exemplary embodiment.

FIGS. 8A and 8B illustrate first roller 4D according to a fourth exemplary embodiment.

In cross section of first roller 4D taken along the rotation axis, as illustrated in FIG. 8A, first roller 4D is shaped to have straight section L1 and first inclined section L2, and second inclined section L3 having curvature r2 connects straight section L1 and first inclined section L2. Adhesive tape comes into contact with straight section L1 and first inclined section L2.

The length of straight section L1 needs to be the same as or longer than the width of adhesive tape 2, and specifically if the width of adhesive tape 2 is 1.0 mm, it is sufficient if the length of straight section L1 is 1.1 mm, in consideration of the tolerance of the width of adhesive tape 2. It is sufficient if the relationship between the lengths of straight section L1 and first inclined section L2 satisfies L1<L2, and first inclined section L2 has a length of 3.0 mm (three times) or longer. In the case of supply reel 3 as illustrated in FIGS. 6B and 7B, a position on supply reel 3 distant from the inner end wall on the balancer 7 side by half the width of adhesive tape 2, the central point of straight section L1 of first roller 4C, and the central point of a surface of second roller 6 which supports adhesive tape 2 (the center in the width direction of a surface in contact with adhesive tape 2) form one plane. The one plane is perpendicular to at least one of the rotation axis of first roller 4C, the rotation axis of second roller 6, or the rotation axis of supply reel 3.

Straight section L1 and first inclined section L2 of first roller 4D are connected by second inclined section L3 having curvature r2, thus allowing adhesive tape 2 to continuously shift on first roller 4D. The angle formed by the rotation axis of first roller 4D and the lateral surface of adhesive tape 2 is about twice the angle in the second exemplary embodiment. However, since adhesive tape 2 is shaped to have straight section L1 and second inclined section having certain curvature r2, adhesive tape 2 is directed along first roller 4D without being bent, and is guided by second roller 6 while a small angle is formed by the rotation axis of first roller 4D and the lateral surface of adhesive tape 2. Actually, if curvature r2 is 2.0 mm, adhesive tape 2 has been successfully guided by second roller 6 without being bent. Accordingly, curvature r2 needs to be 2.0 mm or more. The advantageous effects resulting from tension applied to adhesive tape 2 being maintained constant while balancer 7 is pivoting are equivalent as those described in the first exemplary embodiment above.

If the line member connection device is provided with record winding supply reel 10, by aligning the center of supply reel 10 in the width direction and the center of straight section L1 of first roller 4D as with the case illustrated in FIGS. 2D and 4B, adhesive tape 2 drawn from supply reel 10 forms a straight shape, and the angle formed by the rotation axis of first roller 4D and the lateral surface of adhesive tape 2 is 90 degrees.

Thus, adhesive tape 2 can be guided without being deformed in the width direction. Further, since first roller 4D has second inclined section L3 having curvature r2 between straight section L1 and first inclined section L2, traverse winding supply reel 3 and record winding supply reel 10 can be both supported without changing first roller 4D.

Although the exemplary embodiments above have described, as an example, the case where first roller 4A is attached to balancer 7, first roller 4A which is an intermediate roller does not necessarily need to be attached to balancer 7.

Figure 9:
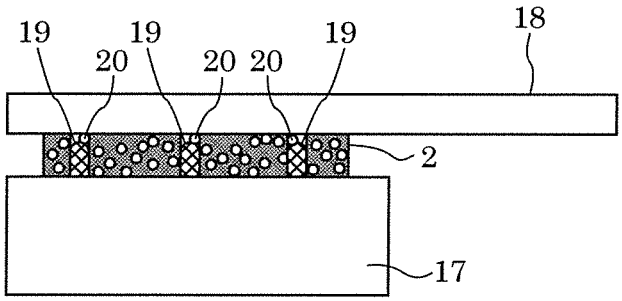
FIG. 9 is a cross-sectional view of a connected portion where a solar cell and a line member are connected with an adhesive tape which is an anisotropically electroconductive resin film.
Figure 10:
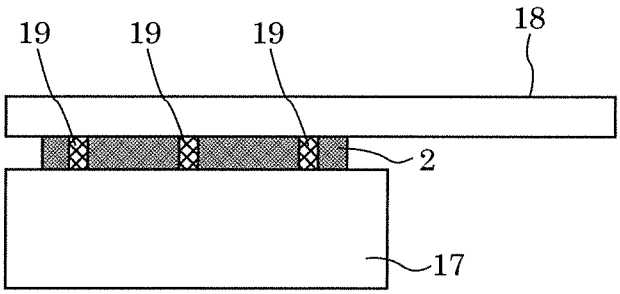
FIG. 10 is a cross-sectional view of a connected portion where the solar cell and the line member are connected with an adhesive tape which is an insulating resin film.

It should be noted that adhesive tape 2 in the exemplary embodiments above may be an anisotropically electroconductive resin film or an insulating resin film. Specifically, FIG. 9 illustrates only a portion above solar cell 17 when adhesive tape 2 is an anisotropically electroconductive resin film. Adhesive tape 2 contains electric conduction particles 20. Cell electrodes 19 are electrically connected to line member 18 via electric conduction particles 20. FIG. 10 illustrates only a portion above solar cell 17 when adhesive tape 2 is an insulating resin film. Cell electrodes 19 break adhesive tape 2, and are electrically connected to line member 18.

It should be noted that the above exemplary embodiments may be combined.

Although only some exemplary embodiments of the present invention have been described in detail above, those skilled in the art will readily appreciate that many modifications are possible in the exemplary embodiments without materially departing from the novel teachings and advantages of the present invention. Accordingly, all such modifications are intended to be included within the scope of the present invention.

INDUSTRIAL APPLICABILITY

The present invention contributes to improvement in productivity of production lines for manufacturing solar batteries, for instance.

What is claimed is:

1. An adhesive tape application device comprising:

a supply reel which supplies an adhesive tape;

a cutter which cuts the adhesive tape drawn from the supply reel;

a first roller via which the adhesive tape drawn from the supply reel is directed to the cutter, the first roller being disposed between the supply reel and the cutter; and an applicator which applies the adhesive tape cut by the cutter onto an object; and a second roller between the cutter and the first roller, the second roller directing the adhesive tape, wherein in cross section taken along a rotation axis of the first roller, a surface of the first roller which supports the adhesive tape along an entire width of the adhesive tape is shaped to have (i) a straight section parallel to the rotation axis and (ii) a first inclined section inclined relative to the rotation axis, the first roller supports the adhesive tape along the entire width of the adhesive tape in the first inclined section, tension of the adhesive tape on a supply reel side of the first roller, tension of the adhesive tape of a cutter side of the first roller, and reaction force exerted by the first roller on the adhesive tape are balanced, and a surface of the straight section and a surface of the first inclined section are continuous with each other, the first inclined section comprises two first inclined sections, the two first inclined sections are respectively positioned on opposite sides of the straight section, one of the two first inclined sections is curved, and the other of the two first inclined sections is straight, a portion of the supply reel which supports the adhesive tape is larger than a portion of the first roller which supports the adhesive tape, the other of the two first inclined sections of the first roller is located closer to an end of the supply reel in a width direction than the one of the two first inclined sections of the first roller, and a point on the supply reel distant from an inner end wall by half the width of the adhesive tape, a central point of the straight section, and a central point of a surface of the second roller which supports the adhesive tape form one plane which is perpendicular to at least one of the rotation axis of the first roller, a rotation axis of the second roller, or a rotation axis of the supply reel.

2. The adhesive tape application device according to claim 1, wherein the straight section has a length greater than or equal to the width of the adhesive tape.

3. The adhesive tape application device according to claim 1, wherein the surface of the first roller has two second inclined sections, the two second inclined sections being respectively positioned between the straight section and one of the first inclined section, and the two second inclined sections are straight.

4. The adhesive tape application device according to claim 3, wherein the straight section parallel to the rotation axis has a length greater than or equal to the width of the adhesive tape.

5. The adhesive tape application device according to claim 3, wherein the second inclined sections have an inclination smaller than an inclination of the first inclined sections.

6. The adhesive tape application device according to claim 1, wherein the surface of the first roller has two second inclined sections, the two second inclined sections being respectively positioned between the straight section and one of the first inclined section, and the two second inclined sections are curved.

7. The adhesive tape application device according to claim 6, wherein the straight section has a length greater than or equal to the width of the adhesive tape.

8. The adhesive tape application device according to claim 6, wherein the second inclined sections have a curvature smaller than the curvature of the first inclined sections.

9. A line member connection device comprising:

the adhesive tape application device according to claim 1; and a connector which places a line member on the adhesive tape, and presses the line member toward the object to electrically connect the line member to the object.

10. The adhesive tape application device according to claim 1, wherein a shaft of the first roller is disposed on a balancer on which the first roller is disposed.

11. The adhesive tape application device according to claim 1, wherein the first roller is disposed on one of two end portions of a balancer, and a counterweight is disposed on the other of the two end portions of a balancer on which the first roller is disposed.

12. The adhesive tape application device according to claim 1, wherein a shaft is disposed in a center of a balancer on which the first roller is disposed, and the balancer keeps balance between the first roller and a counterweight by being supported pivotably about the shaft.

13. The adhesive tape application device according to claim 1, wherein the adhesive tape is an anisotropically electroconductive resin film.

14. The adhesive tape application device according to claim 1, wherein the straight section and the respective first inclined sections on opposite sides of the straight section are continuous with each other with no boundary area therebetween.

* * * * *